United States Patent [19]

Richer et al.

[11] Patent Number: 4,974,803

[45] Date of Patent: Dec. 4, 1990

[54] RECEPTACLE HOLDER

[76] Inventors: André Richer; Jean-Pierre Lefebvre, both of 7659 André Merlot, Lasalle, Québec, Canada, H8N 2G5

[21] Appl. No.: 350,697

[22] Filed: May 10, 1989

[51] Int. Cl.[5] ..... A47B 96/00

[52] U.S. Cl. ..... 248/214; 248/305; 248/311.2; 248/340

[58] Field of Search ..... 248/311.2, 214, 215, 248/255.1, 339, 340, 301, 304, 305; 182/119, 121, 122; 24/116 A

[56] References Cited

U.S. PATENT DOCUMENTS

| | | | |
|---|---|---|---|
| 1,072,022 | 9/1913 | Miller . | |
| 2,432,206 | 12/1947 | Mott | 182/121 |
| 2,550,019 | 4/1951 | Murphy . | |
| 2,724,881 | 11/1955 | DiMaria | 24/116 A |
| 2,908,396 | 10/1959 | Odlozil . | |
| 2,938,695 | 5/1960 | Ciampa | 248/214 |
| 3,007,664 | 11/1961 | Fairhanks et al. . | |
| 3,016,149 | 1/1962 | Dean . | |
| 3,881,677 | 5/1975 | Ihlenfeld | 248/311.2 |
| 3,892,315 | 7/1975 | Johnson . | |
| 3,980,202 | 9/1976 | Monyak et al. . | |
| 4,247,070 | 1/1981 | Dirksing | 248/215 X |
| 4,436,269 | 3/1984 | Dirksing et al. | 248/215 X |
| 4,455,692 | 6/1984 | Hegge et al. | 248/214 X |
| 4,643,380 | 2/1987 | Copeland . | |

FOREIGN PATENT DOCUMENTS

| | | | |
|---|---|---|---|
| 375741 | 3/1932 | United Kingdom | 248/311.2 |

*Primary Examiner*—David L. Talbott

[57] ABSTRACT

There is described a holder for mounting along a horizontal support which enables a receptacle to be connected thereto. The holder comprises a rectangular member having outwardly projecting flanges along the lateral edges thereof, the first plate member hinged to the rectangular member and a second plate member hinged to the second plate member. Additionally, there is a base plate at the bottom of the rectangular member. The first plate member projects inwardly from the rectangular member while the base plate projects outwardly thereof. The second plate member can be attached to the rectangular plate such as by means of a plurality of elongated members, each having a plurality of engageable balls formed therealong. Slots are provided in the plate member to receive the strand and balls which can be adjustably mounted along the sleeve when mounting the holder on the horizontal support. Sliders are associated with the receptacle to be engaged by the flanges so as to connect the receptacle to the holder. The receptacle rests on the base plates when the sliders have been fully engaged by the flanges. This arrangement permits for example the mounting of a garbage holder outside the railing of an ordinary veranda.

1 Claim, 2 Drawing Sheets

RECEPTACLE HOLDER

BACKGROUND OF THE INVENTION

1. Field of the Invention

This invention relates to a receptacle holder for mounting along a horizontal support. More particularly, the invention relates to a device enabling to mount any kind of receptacles, such as garbage pails, and supports of all kinds on the outside of the railing of a veranda.

2. Description of the Prior Art

It is well known that small residential verandas very rapidly become clogged with a variety of articles, such as tables, chairs, various tools and garbage pails or bags, with the result that there is a very limited area for enjoying life outside. On the other hand, it is traditional especially in multi-dwelling houses, to place garbage pails or bags on the veranda, since this is the most appropriate place.

There is therefore a need to dispose of some of the material which is normally found on the veranda while making the additional space readily available to the user.

Some receptacle holders are known in the prior art, such as those found in the following United States Patents:

1,072,022
2,550,019
2,908,386
3,007,664
(prior art continued)
3,016,149
3,892,315
3,980,202
4,643,380

However, either in view of their cost or their construction, these holders could not be easily adapted for mounting on the outside of the railing of a veranda.

SUMMARY OF THE INVENTION

It is therefore an object of the present invention to provide for a receptacle holder which is cheap to manufacture and can easily and readily be installed for mounting on the outside of the railing of a veranda.

This and other objects can be achieved by providing a receptacle holder for mounting along a horizontal support, and means enabling to connect the receptacle to the holder. The holder comprises a rectangular member, outwardly projecting flange means formed along lateral edges of the rectangular member, a first plate member hinged to the rectangular member, a second plate member hinged at the top of the second plate member, and a base plate at the bottom of the rectangular member. The first plate member is intended to project inwardly of the rectangular member and the base plate projects outwardly thereof. A plurality of attaching means are provided along the edge of the second plate member, each attaching means being formed with a plurality of engageable means thereon. There are provided, a plurality of engaging means on the rectangular member to adjustably receive the engageable means when mounting the holder on the horizontal support. Means to connect the receptacle to the holder are associated with the receptacle and comprise slider means engageable over the flange means, the receptacle resting on the base plate when the slider means have been fully engaged by the flange means.

BRIEF DESCRIPTION OF THE DRAWINGS

The invention is illustrated by means of the annexed drawings in which.

DESCRIPTION OF THE PREFERRED EMBODIMENTS

Figure 1:
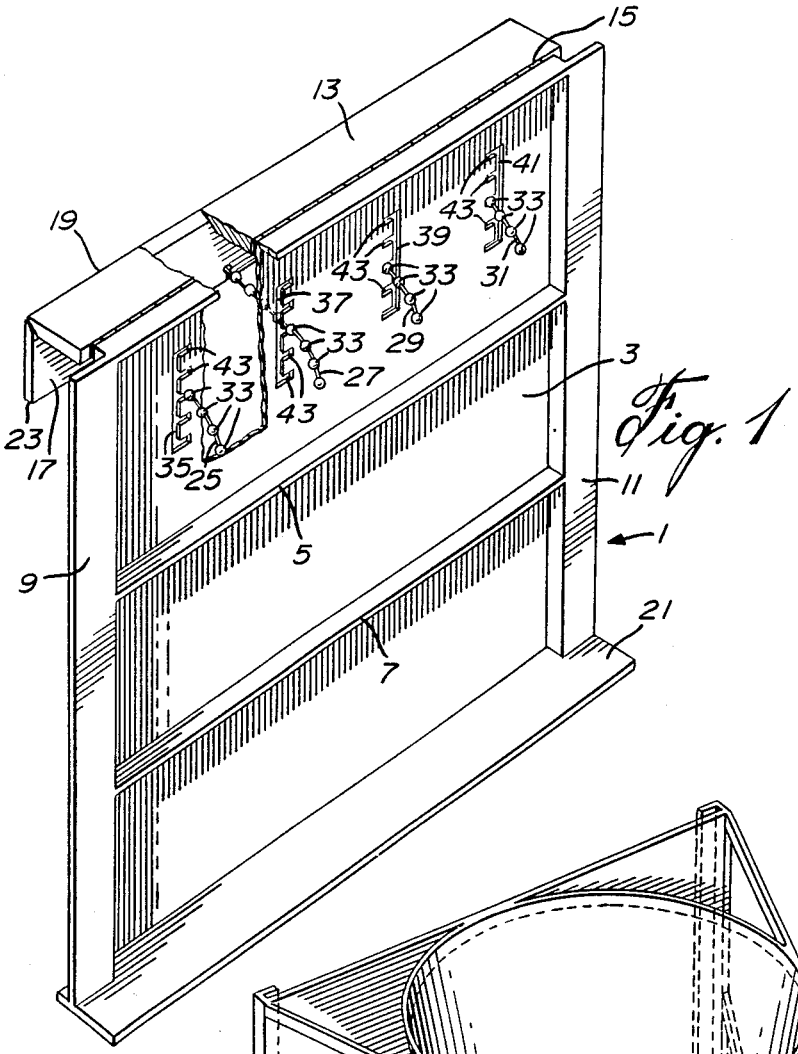
FIG. 1 is a perspective view of the receptacle support.

With reference to the drawings, it will be seen that a holder 1, according to the invention, comprises a rectangular plate member 3 which is reinforced by two ribs 5 and 7. Along the lateral edges of the rectangular member 3, there are provided outwardly projecting flanges 9 and 11. At the top, there is a plate member 13 which is hinged at 15 to the rectangular member and a second plate member 17 which is hinged at 19 to the plate member 13. It will easily be realized that for mounting the holder according to the invention it is merely necessary to place it on the outside of a veranda railing (not shown), and to engage the top rail (not shown) by means of the plate members 13 and 17 as will be shown later. Fixation of the holder on the top rail will be described later. At the bottom of the rectangular member, there is a base plate 21 which will be used to hold the receptacle once the latter has been connected to the holder 1.

Referring again to FIG. 1, it will be seen that the lower edge 23 thereof has a plurality of elongated string-like members 25, 27, 29, 31, which hang therefrom in the manner illustrated in the drawings. Regularly distributed along the string-like members 25, 27, 29, 31, there are a plurality of ball-shaped enlargements 33.

In the upper portion of the rectangular member 3, there are provided vertically extending slots 35, 37, 39, 41, in which the string-like members 25, 27, 39 and 31 can respectively be inserted. Each slot 35, 37, 39, 41, has a plurality of horizontal notches 43 in which a particular enlargement 33 can be inserted. It will be realized that once the plate members 13 and 17 have been placed over a top rail (not shown), it is merely necessary to introduce a string-like member in one of the slots 35, 37, 39 or 41, and to engage one of the enlargements 33 in one of the notches 43, until the holder is fixedly engaged by the upper rail.

Figure 4:
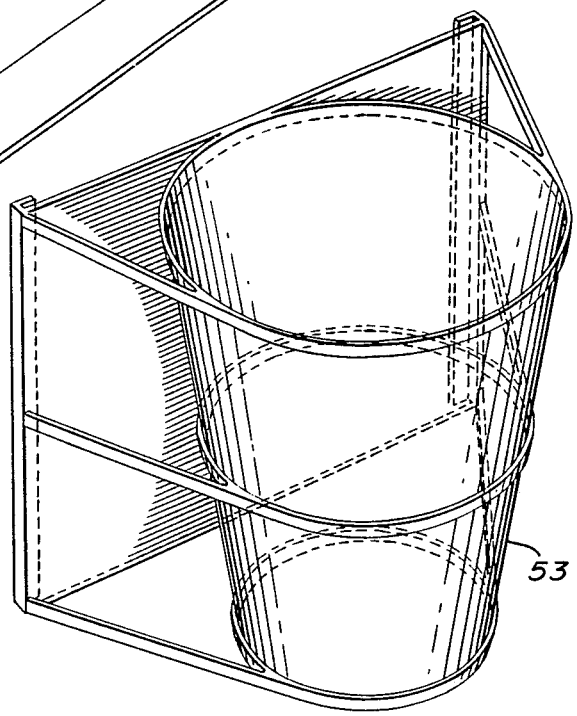
FIG. 4 is a perspective view of yet another type of receptacle.
Figure 2:
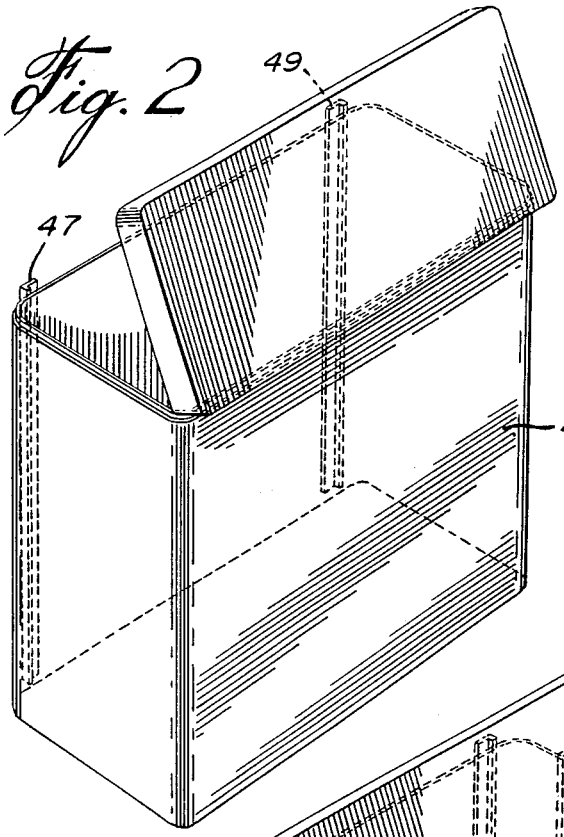
FIG. 2 is a perspective view of a box-like receptacle which can be engaged by the holder illustrated in FIG. 1.
Figure 3:
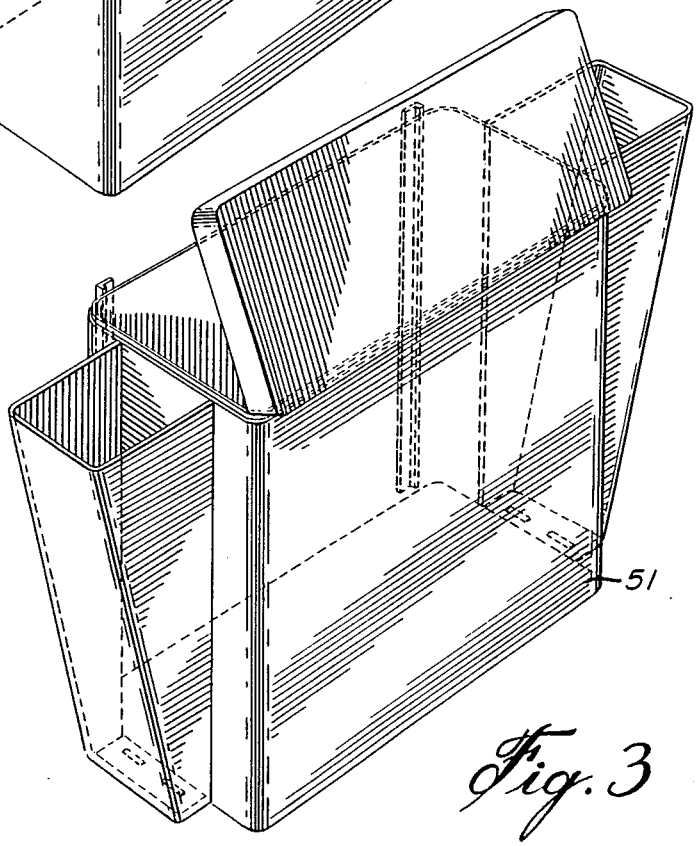
FIG. 3 is a perspective view of another receptacle that can be engaged by the holder illustrated in FIG. 1

Referring to FIG. 2, which illustrates a rectangular container 45, it will be seen that associated with this container 45, there are two L-shaped sliders 47, 49, which can engage over a flange 9, 11. Once the sliders have been fully engaged over the flanges 9, 11, the receptacle 45 or 51, (FIG. 3) or 53 (FIG. 4) rests on the base plate 21.

The device is quite easy to manufacture since it can readily be moulded or shaped as is readily known to anyone skilled in the art. Similarly, a receptacle can easily be provided with a pair of sliders 47, 41 as will be apparent to anyone skilled in the art. Once the holder 1 has been mounted on the outside of a veranda railing, and by attaching it to the upper rail by means of the plate members 13, 17, using string-like members 25, 27, 29, 31, in the manner shown above, it is merely necessary to attach the receptacle thereto by means of the sliders and flange described above.

We claim:

1. A receptacle holder for mounting along a horizontal support, and means enabling to connect said receptacle to said holder, said holder comprising a rectangular member, outwardly projecting flange means formed along lateral edges of said rectangular member, a first plate member hinged at the top of said rectangular member, a second plate member hinged to said first plate member, and a base plate at the bottom of said rectangular member, said first plate member to project inwardly of said rectangular member and said base plate to project outwardly thereof, a plurality of adjustable string attaching means along the edge of said second plate member, each said adjustable string attaching means being formed with a plurality of ball-shaped means thereon, a plurality of vertical slots with horizontal notches formed on said rectangular member to adjustably receive said attaching adjustable string means in said slot and said ball-shaped means in one of said notches when mounting said holder on said horizontal support, said means to connect said receptacle to said holder associated with said receptacle and comprising slider means engageable over said flange means, said receptacle resting on said base plate when said slider means have been fully engaged by said flange means.

* * * * *